United States Patent [19]

Heinold et al.

[11] 3,967,399

[45] July 6, 1976

[54] RETAINING MEANS FOR GROUND-ENGAGING TOOL

[75] Inventors: Lloyd K. Heinold; Richard E. Livesay, both of Peoria, Ill.

[73] Assignee: Caterpillar Tractor Co., Peoria, Ill.

[22] Filed: Aug. 5, 1974

[21] Appl. No.: 494,405

[52] U.S. Cl. ..... 37/142 A; 37/142 R; 85/8.3; 172/713; 279/97; 279/99; 403/296; 403/379

[51] Int. Cl.[2] ..... E02F 9/28; B25G 3/26

[58] Field of Search ..... 37/141 R, 141 T, 142 R, 37/142 A; 172/699, 713, 719, 751, 753, 762, 763, 769, 772; 403/111, 291, 46, 341, 234, 296, 379; 299/91, 92, 93; 85/8.3; 279/97, 99, 86

[56] References Cited

UNITED STATES PATENTS

| | | | |
|---|---|---|---|
| 137,674 | 4/1873 | Goodsell | 403/379 X |
| 288,459 | 11/1883 | Leet | 403/296 |
| 642,677 | 2/1900 | Childs | 279/99 UX |
| 1,382,155 | 6/1921 | Wirt | 279/86 |
| 1,674,983 | 6/1928 | Morton | 403/111 X |
| 1,815,420 | 7/1931 | Savvage | 403/46 |
| 1,945,430 | 1/1934 | Garrett | 403/341 X |
| 2,716,822 | 9/1955 | Launder et al. | 37/142 A |
| 2,874,491 | 2/1959 | Larsen | 37/142 R |
| 3,025,619 | 3/1962 | Towne et al. | 37/142 A |
| 3,188,756 | 6/1965 | Baer | 37/142 A |
| 3,203,488 | 8/1965 | Eastwood | 172/713 |
| 3,557,402 | 1/1971 | Koehl | 85/8.3 X |
| 3,630,261 | 12/1971 | Gley | 85/8.3 X |
| 3,675,350 | 7/1972 | Mulcahy et al. | 37/142 A |
| 3,678,605 | 7/1972 | Prime | 37/142 A |

FOREIGN PATENTS OR APPLICATIONS

| | | | |
|---|---|---|---|
| 237,468 | 10/1959 | Australia | 37/142 |
| 1,468,477 | 2/1967 | France | 299/91 |
| 1,096,146 | 12/1967 | United Kingdom | 299/92 |

*Primary Examiner*—Edgar S. Burr
*Assistant Examiner*—Steven A. Bratlie
*Attorney, Agent, or Firm*—Phillips, Moore, Weissenberger, Lempio & Strabala

[57] ABSTRACT

Retaining means for releasably retaining an earth-working tool on a support member includes a socket and adjustably partially misaligned holes extending transverse of the socket and a radially resilient retaining pin extending through the holes.

7 Claims, 6 Drawing Figures

RETAINING MEANS FOR GROUND-ENGAGING TOOL

BACKGROUND OF THE INVENTION

The present invention relates to earth-working tools and pertains particularly to retaining means for retaining excavating teeth or the like on a support member.

Replaceable earth-working tools such as digging teeth for excavating implements are well known, as are means for detachably securing such teeth to such implements. Examples of the known prior art are as follows:

U.S. Pat. No. 2,385,395 issued Sept. 25, 1945, to Baer; No. 2,874,491 issued Feb. 24, 1959 to Larson; No. 3,371,437 issued Mar. 5, 1968 to Wilson et al; No. 3,413,739 issued Dec. 3, 1968 to Guinot; No. 3,469,332 issued Sept. 30, 1969 to Leffingwell; and No. 3,509,648 issued May 5, 1970 to Smith.

It is desirable that such mounting means be able to take up slack or wear which may occur between the earth-working tool and the supporting member. It is also desirable that the retaining means be such as to be able to take the loads necessary for accomplishing the purpose of the machine or tool. It is necessary that the load be supported on other than the retaining pins since the pins are generally unable to carry the shear loads imposed thereon.

While means are known to the prior art for compensating for such wear, such means require constant adjustment and do not automatically take up certain amounts of slack. Many of the prior art devices also require a very exacting and precise machining in order to properly distribute the load from the tip to the supporting shank.

SUMMARY AND OBJECTS OF THE INVENTION

It is a primary object of the present invention to provide detachable tool mounting means that overcome the above problems of the prior art.

Another object of the present invention is to provide tool-retaining means that includes adjustable retaining means such that inaccurate machining and wear may be compensated for within the mounting means.

Another object of the present invention is to provide detachable retaining means for a tool that includes adjustable means for compensating for wear and misalignment and includes resilient means to take up slight amounts of wear and misalignment.

In accordance with the primary aspect of the present invention, a socket assembly for mounting an earth-working tool on a support member is provided with a socket and transverse pin arrangement wherein the pin is fitted into slightly misaligned holes which are adjustably misaligned and the pin is a resiliently radially expanding pin to compensate for the misalignment.

BRIEF DESCRIPTION OF THE DRAWINGS

The above and other objects and advantages of the present invention will become apparent from the following description when read in conjunction with the accompanying drawings wherein.

DETAILED DESCRIPTION OF PREFERRED EMBODIMENT

Figure 1:
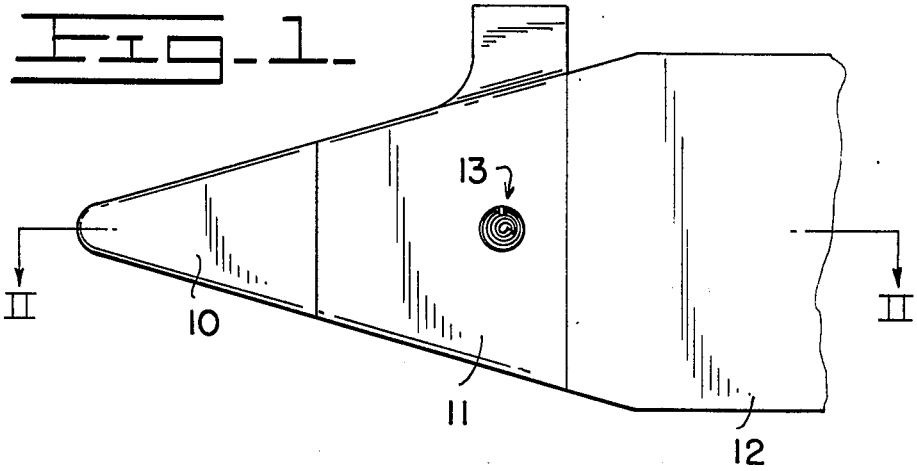
FIG. 1 is an elevational view of a tool embodying the preferred embodiment of the present invention.

Referring now to the drawings, and particularly to FIG. 1, there is illustrated an earth-working or separating tool such as a ripper tip or tooth 10 mounted with an adapter 11 to a support member or shank 12 by means of a retainer pin assembly indicated generally at 13. The adapter member 11 may be excluded when not necessary or may serve another function such as a shield or the like for the support member or shank 12. The illustrated embodiment is designed particularly for a ripper tip but may be utilized for other earth-working tools such as tampers, bucket teeth, and other similar devices.

Figure 2:
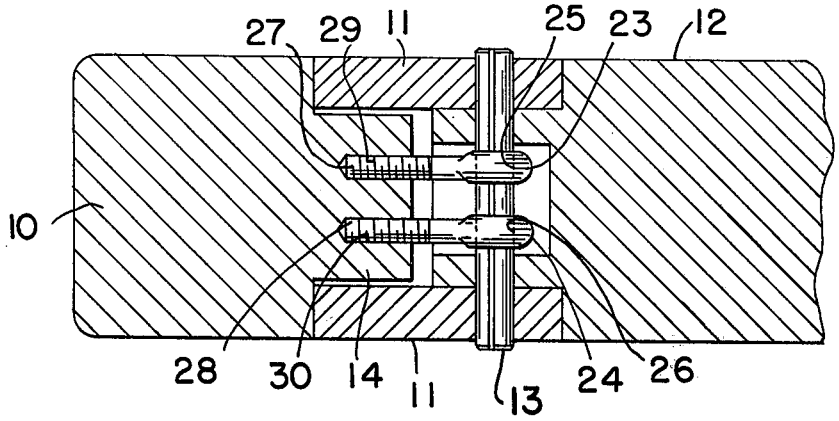
FIG. 2 is a sectional view taken generally along lines 2—2 of FIG. 1.

As best seen now in FIG. 2, the tip or tooth 10 includes a shank or extension 14 which is telescopically received within a forward socket 15 which is open to a rear socket 16 defined by a stepped, through passage within the adapter member 11. The tooth 10 also includes a shoulder 17 formed around the shank 14 for abutting corresponding shoulders 18 formed around the socket 15 of adapter 11. The shank or support member 12 includes a forward extension 19 which is adapted to be telescopically received into socket 16 and includes shoulders 20 surrounding the forward extension 19 adapted to engage shoulders 21 formed on the adapter member 11. The forward extension 19 of shank 12 also includes a socket 22 for telescopically receiving a pair of eyebolts 23 and 24 which define a pair of holes 25 and 26 on or in the tip member 10 for receiving the retaining member or pin 13.

The eyebolts 23 and 24 are each threadably mounted by means of threads 27 and 28 in threaded bores 29 and 30 formed in the tooth or tip 10. This threaded engagement permits the center of holes 25 and 26 to be adjusted inward or outward with respect to the shoulders 17. This in turn adjusts the center of these holes with respect to aligned bores 31 and 32 in member 12 and 33 and 34 in the adapter member 11. These bores, when in partial alignment or partial misalignment, as the case may be, are adapted to receive the radially resilient retaining pin 13. The pin 13 is adapted to be compressed radially inwardly in order to be received in the misaligned bores and to expand radially outward to maintain contact therewith and to maintain the shoulders at 17 and 18 in tight engagement.

Figure 3:
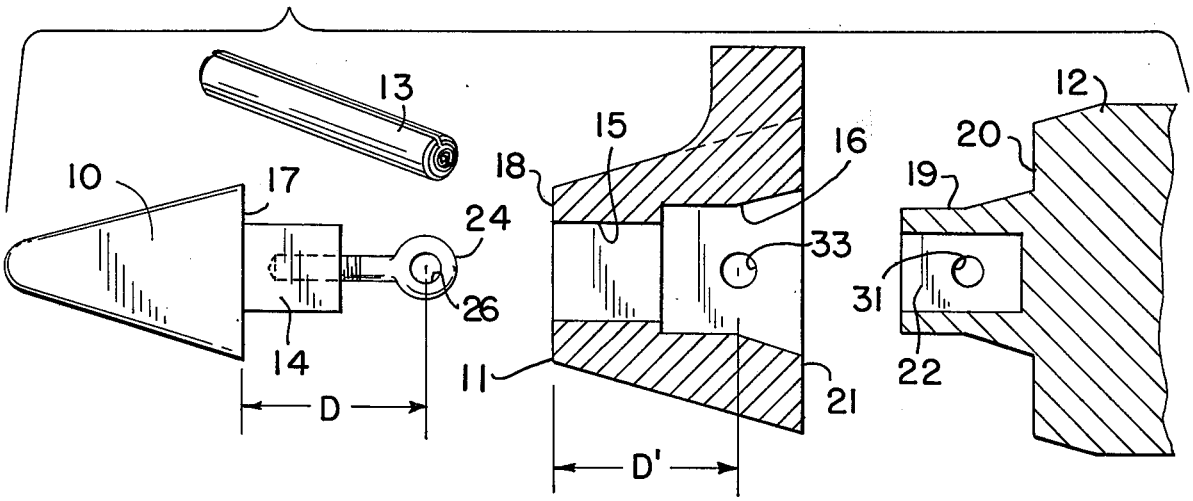
FIG. 3 is an exploded view of the assembly of FIG. 1.
Figure 4:
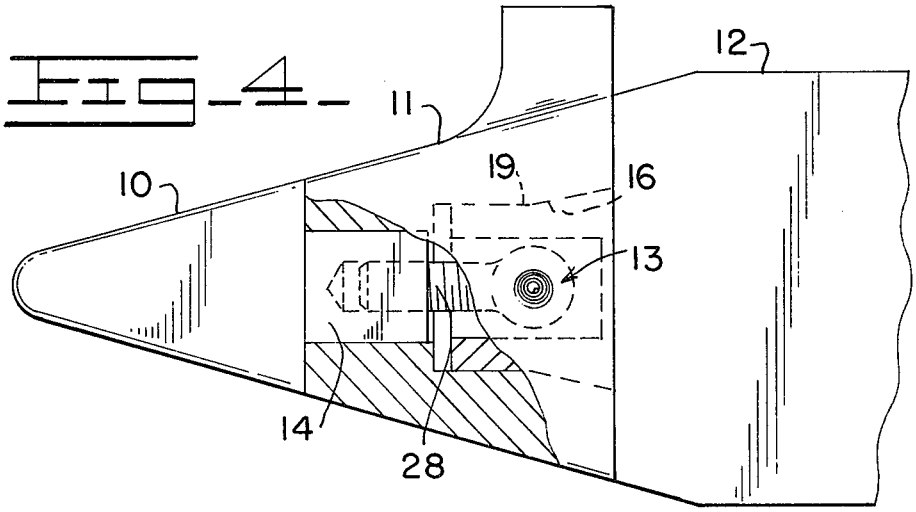
FIG. 4 is a view substantially like FIG. 1 with portions broken away to show details of the construction.

The adjustable misalignment of the assembly is between the holes 25, 26 of the members 23, 24 and the holes 31 and 32 and 33, 34 of the members 11 and 12. This distance, as indicated in FIG. 3, is the distance D between shoulder 17 and the center of bore 26 and the distance D′ between the shoulder 18 and the center of holes 33. With this adjustment the distance D is preferably less than that of D′ to retain the shoulder 17, 18 into tight engagement.

Figure 5:
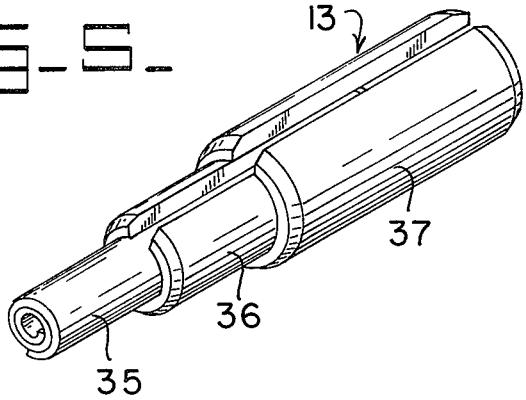
FIG. 5 is a partially exploded perspective view of the pin for the assembly of FIG. 1.

Turning now to FIG. 5, there is illustrated the preferred construction or embodiment of the retaining pin 13. This construction generally comprises an elongated spiral-wound spring 35 defining the inner member, an intermediate roll spring 36, and an outer roll spring 37 all concentrically mounted with respect to one another.

Figure 6:
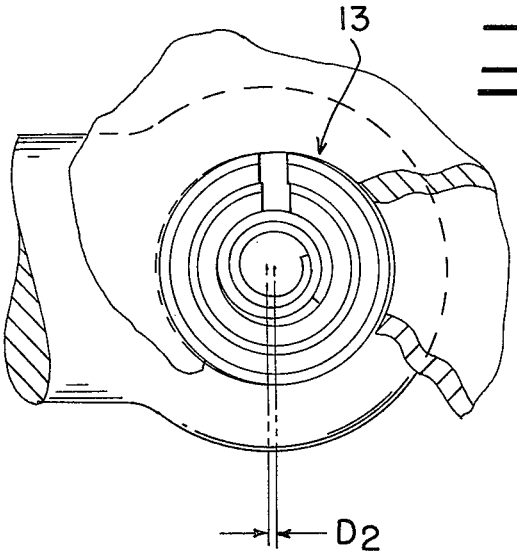
FIG. 6 is an enlarged detailed end view of the pin assembly of FIG. 1.

This construction permits the entire pin to be radially compressed inward or, in the case as best seen in FIG. 6, to be distorted to be substantially an elliptical cross-sectional shape upon assembly due to the slight misalignment between the holes in the tip and the holder member. The inner pin 35, as can be seen in FIG. 5, includes a plurality of rolls of the spring member from the inside out to define the pin. The other two pins, 36 and 37, are each comprised of a member substantially defining a sleeve interrupted by a slot extending its entire length. The slot is preferably constructed of sufficient width to permit a reasonable degree of deformation in the diameter of the pin. The pin members are preferably constructed of a material such as spring steel.

Turning now to FIG. 6, there is illustrated a more detailed view of the pin in the assembled position in the assembly. The degree of misalignment of the pin holes are designated by the arrows indicated by the distance $D_2$. The pin 13 has deformed or deflected to accommodate this amount of difference in the alignment of the respective holes.

The radial resilience or elasticity of the pin 13 maintains the shoulders 17 and 18 into tight engagement and will accommodate a substantial amount of wear and/or misalignment between these shoulders. Such wear may generally occur in such equipment and constant adjustment between the members 10 and 11 will be unnecessary with this arrangement. However, should it become necessary to adjust for a substantial amount of wear, it is only necessary that the pin 13 be removed and the eyebolts 23 and 24 be screwed down a slight amount to again increase the misalignment between the holes 25, 26 and 33, 34. With this misalignment, the shoulders will again be maintained into tight engagement for the range of expansion of the pin 13.

Any one of the members making up pin 13 may itself serve as the pin if desired. For example, the element 35 may be sufficiently large and have sufficient resilience to accommodate the misalignment and serve the pin purpose. Likewise, either one of the members 36 or 37 may similarly serve the same purpose.

While the present invention has been described with respect to a single embodiment, it is to be understood that numerous changes and modifications may be made therein without departing from the spirit and scope of the invention as defined in the appended claims.

We claim:

1. In an earth-working device, the combination comprising:

support means including means defining a shank-receiving socket extending along an axis;

a tooth element having a digging portion and a narrower shank extending along an axis away from said digging portion for being received in said socket for thereby mounting said tooth element on said support means;

a pair of aligned bores formed in said support means transverse to the axis of and intersecting said shank receiving socket;

detachable adjustable means one end secured to and carried by said shank the other end defining a fixed diameter bore extending transverse to the axis of said shank, the axis of said bore being independently selectively adjustable along said axis of said shank for selected partial misalignment of said axis of said bore with the axis of said bores in said support member; and, an elongated generally cylindrical radially expandable pin extending through said partially aligned bores for simultaneous engagement with said bore of said adjustable means on said shank and said bores in said socket for biasing said tooth element into engagement with said support means for retaining said shank in said socket.

2. The tooth mounting assembly of claim 1 wherein said bore on said shank is normally displaced toward said digging portion relative to the bores in said support means.

3. The tooth mounting assembly of claim 2 wherein said pin comprises an elongated generally cylindrical roll spring wound about its axis.

4. The tooth mounting assembly of claim 2 wherein said pin comprises an elongated generally cylindrical spiral wound spring wound about its axis.

5. In an earth-working device, the combination comprising:

support means defining a shank-receiving socket formed therein and extending along an axis;

a tooth element having a digging portion and a shank extending along an axis for being received in said socket for mounting said tooth element on said support means;

a pair of aligned bores formed in said support means transverse to the axis of and intersecting said socket;

adjustable means including an eyebolt threadably secured to the end of said shank, the eye of said bolt defining a bore having an axis extending transverse to the axis of said shank and being adjustable along said axis of said shank for partial misalignment with said bores in said support member; and, an elongated generally cylindrical radially expandable pin comprises an inner elongated spiral wound spring, and an outer roll spring extending through said partially misaligned bores for simultaneous engagement with said bore on said shank and said bores in said socket for retaining said shank in said socket.

6. The tooth mounting assembly of claim 5 wherein said support means includes shoulder means surrounding said socket; and, said tooth element includes shoulder means surrounding said shank for engagement with said shoulder means of said support means.

7. The tooth mounting assembly of claim 6 wherein said support means includes an adapter defining an extension of said socket and includes a pair of aligned bores receiving said pin.

* * * * *